US006216759B1

(12) United States Patent
Guerrieri

(10) Patent No.: US 6,216,759 B1
(45) Date of Patent: Apr. 17, 2001

(54) METHOD AND APPARATUS FOR GLUING FRAMES, MIRRORS, GLASS SHEETS AND THE LIKE TO PANELS, IN PARTICULAR FURNITURE PANELS

(76) Inventor: Giuliana Guerrieri, Via Bellaguardia 23, Fossombrone (Pesaro) (IT), 61034

( * ) Notice: Subject to any disclaimer, the term of this patent is extended or adjusted under 35 U.S.C. 154(b) by 0 days.

(21) Appl. No.: 09/142,307

(22) PCT Filed: Mar. 11, 1997

(86) PCT No.: PCT/IB97/00239

§ 371 Date: Sep. 3, 1998

§ 102(e) Date: Sep. 3, 1998

(87) PCT Pub. No.: WO97/33732

PCT Pub. Date: Sep. 18, 1997

(30) Foreign Application Priority Data

Mar. 12, 1996 (IT) ..... 960016
Jul. 29, 1996 (IT) ..... 96A0017

(51) Int. Cl.[7] ..... B05C 9/06; B05C 9/12; B05C 13/02

(52) U.S. Cl. ..... 156/356; 156/368; 156/556; 156/578; 156/581

(58) Field of Search ..... 156/511, 391, 156/576, 578, 368, 356, 556, 581; 118/302, 315, 323, 313, 316, 669; 359/883, 900; 52/457, 458, 455

(56) References Cited

U.S. PATENT DOCUMENTS

| | | | | |
|---|---|---|---|---|
| 2,197,528 | * | 4/1940 | Makenny et al. . | |
| 3,503,369 | | 3/1970 | Moore . | |
| 3,766,885 | * | 10/1973 | Brenner et al. | 118/313 |
| 3,907,624 | * | 9/1975 | Gravely, Jr. | 156/214 |
| 4,010,203 | * | 3/1977 | Aylon | 156/578 |
| 4,056,075 | | 11/1977 | Seiderman . | |
| 4,173,275 | * | 11/1979 | Pfeiffer et al. | 198/421 |
| 4,369,613 | * | 1/1983 | Gess | 53/553 |
| 4,564,410 | * | 1/1986 | Clitheros et al. | 156/356 |
| 4,605,049 | * | 8/1986 | Giordanengo et al. | 144/144 R |
| 4,793,878 | * | 12/1988 | Giorgio et al. | 156/64 |
| 4,872,417 | * | 10/1989 | Kuwabara et al. | 118/411 |
| 4,979,890 | * | 12/1990 | Bracesco | 425/399 |
| 5,334,249 | * | 8/1994 | Osbon | 118/679 |
| 5,568,713 | * | 10/1996 | Gagne et al. | 52/785.1 |

FOREIGN PATENT DOCUMENTS

| | | |
|---|---|---|
| 26 51 412 | 11/1976 | (DE) . |
| 29 36 369 A1 | 9/1979 | (DE) . |

(List continued on next page.)

*Primary Examiner*—Michael W. Ball
*Assistant Examiner*—Gladys Piazza
(74) *Attorney, Agent, or Firm*—William J. Sapone; Coleman Sudol Sapone, P.C.

(57) ABSTRACT

The method and apparatus allow more precise and quicker gluing of frames and mirrors or glass having different shapes and dimensions to furniture panels in general. According to the method, strips of glue are deposited onto a furniture panel by means of sprayer pistols or nozzles and then the frame or the mirror sheet is applied to the panel. The apparatus which carries out the method includes one or more cross-bars sliding over the panel supporting table, and slide carriages carrying the sprayer pistols or nozzles and running along the cross-bar. The apparatus having this configuration can apply the glue along any desired path which preferably matches with the frame or mirror shape. It is also possible to have the apparatus working in accordance with a program prepared in a computer control station.

In a further embodiment, the apparatus is equipped with a placing and pressing element which can either support a plate carrying a template for the frame, or keep the mirror sheet while the glue is applied and then place the mirror on the panel, in the correct position, pressing it in a uniform way.

20 Claims, 8 Drawing Sheets

FOREIGN PATENT DOCUMENTS

| | | |
|---|---|---|
| 286 321 A5 | 10/1983 | (DE) . |
| 235 223 A1 | 3/1985 | (DE) . |
| 380558 C1 | 2/1988 | (DE) . |
| 91 05 538 U | 5/1991 | (DE) . |
| 0 130 725 A2 | 6/1984 | (EP) . |
| 0 421 792 A2 | 10/1990 | (EP) . |
| 03295647 | 12/1991 | (EP) . |
| 2 640 334 | 12/1988 | (FR) . |
| 2 699 549 | 12/1992 | (FR) . |
| 002033320 | 5/1980 | (JP) . |

* cited by examiner

METHOD AND APPARATUS FOR GLUING FRAMES, MIRRORS, GLASS SHEETS AND THE LIKE TO PANELS, IN PARTICULAR FURNITURE PANELS

BACKGROUND OF THE INVENTION

The present invention concerns a method and an apparatus for application of frames or mirrors of different shapes and dimensions to furniture panels in general. The method and the apparatus herein disclosed allows a quicker and more precise application of the frame or mirror to each panel.

DESCRIPTION OF THE PRIOR ART

In the furniture industry ornamental frames, mirrors or glasses are often to be applied to furniture panels.

Once the mirrors were applied to e.g. wardrobe doors by means of peripheral frames screwed to the panels used to make the doors.

However, fixing frames required long time to be mounted and the result was not always aesthetically acceptable.

To decrease the time necessary to set the mirrors and improve the aesthetic result, adhesive means are now used, which grip the mirrors at the back. This allows to apply also ornamental frames without any need to make holes in the panels for the screws or nails.

Up to now, ornamental frames or mirrors have been usually applied by means of double-adhesive sided tape, which was applied manually, in pieces, that obviously causes a considerable waste of time.

Another drawback of the double-adhesive sided tape is that the grip between the mirror and the panel is too rigid along the whole extension of the mirror.

The panels are often subjected to bending, e.g. during transport, or may fall down or have to support considerable weight, e.g. because of piling, and these facts taken alone or in combination often result in breaking of the mirror. Document DD-A5-286,321, to WEB MOBELWERKE EISENBERG, discloses a method for applying mirrors or glass sheets to panels by depositing at least one strip of hot glue onto the mirror or glass sheet, and then applying the panel to said mirror or glass sheet. This is made automatically, by using a single glue sprayer moving along guide rails, while the mirror or glass sheet is carried by a movable carriage. This method is not very efficient, particularly when high production rates or high accuracy are required.

Another problem arisen with the use of the known techniques derives from the fact that the panel to which a frame or a mirror has to be applied is often slightly curved.

When a frame is applied the bending of the panel provokes misalignment of its sides, which therefore must be kept in the correct position while the frame. is placed on the panel, that is not always a simple operation, in particular if long frames are processed.

The adhesive tape is first applied to the backside of the frame, and a wrong positioning of the frame on the panel requires detachment therefrom and reapplying of the frame. Obviously, this could damage the surface of the panel and increases the time required for the operation.

Moreover, times imposed by the industrial processing do not allow to strengthen those parts which are most subjected to breaking, because of e.g. through holes for handle screws or the like.

SUMMARY OF THE INVENTION

An object of the present invention is to facilitate the application of frames, mirrors, glass and the like on wardrobe doors or furniture panels in general, no matter of the condition, i.e. perfectly flat or slightly curved, of the panels.

Another object of the present invention is to make quicker and more precise the application of frames or mirror of different shapes and dimensions to furniture panels in general.

Yet another object of the present invention is to improve the breaking resistance of the fixed glass sheets, by optimal application of adhesive means, so that the two joined parts are less rigid and the most critical parts are reinforced.

A further object is to reduce the quantity of adhesive means to the just necessary quantity, with suitable adhesive means distribution, so as to reinforce the most stressed areas and avoid an excessive rigidity between the parts, which could provoke sheets breaking during bending.

Finally, it is another object of the invention to improve and make more durable the grip between the joined parts and guarantee a high level of finishing, aesthetically perfect. The above mentioned objects are obtained by means of a method for gluing mirrors, frames or glass sheets and the like to panels, in particular furniture panels, which includes depositing at least one strip of hot glue onto a panel, along a pre-determined path and then applying the mirror, frame or glass sheet to the panel.

To carry out the method, it is proposed an apparatus for gluing mirrors, frames or glass sheets and the like to panels, in particular furniture panels, which includes:

at least one table for receiving a panel thereon;

at least one horizontal cross bar extending over said table and connected to motor means for sliding over said table;

at least one slide running along said cross bar and equipped with at least one sprayer pistol for depositing at least one strip of glue on predetermined areas of said panel;

motor means for moving said slide along said cross bar.

Preferably the apparatus is equipped with an articulated place and press element which can rotate from an inclined position, in which the frame or mirror is loaded, to the horizontal working position, where actuator means push the place and press element downward on said panel, to apply the frame or mirror, and then pull the place and press element upward leaving the frame or mirror attached to said panel.

The place and press element is supported by a support bar extending over said table, with rotary actuator means interposed between said support bar and a plurality of uprights which connect said support bar to corresponding ends of said table.

The place and press element carries a frame receiving template of a shape corresponding to the frame shape and made of material having such elasticity that allows to compensate for possible working tolerances and deformations of the frame and the panel.

The machine, according to the present invention, is equipped with one or more movable cross bars, sliding over the panels supporting table, along which carriages carrying pistols or nozzles distributing hot glue can translate.

The cross bar and the carriages are moved in such a way as to deposit the glue along the desired path, corresponding to the frame shape, according to a program prepared in a numerical control station.

Moreover, the apparatus is equipped with a particular articulated pressing element supporting the frame, aimed at maintaining the frame in the correct position and pressing it in a uniform way, so as to compensate for deformations and inevitable working tolerance.

BRIEF DESCRIPTION OF THE DRAWINGS

Now a more detailed description of the invention will follow, with reference to the enclosed drawings, which illustrate, only as possible examples, different embodiments.

BEST MODES OF CARRYING OUT THE INVENTION

Figure 1:
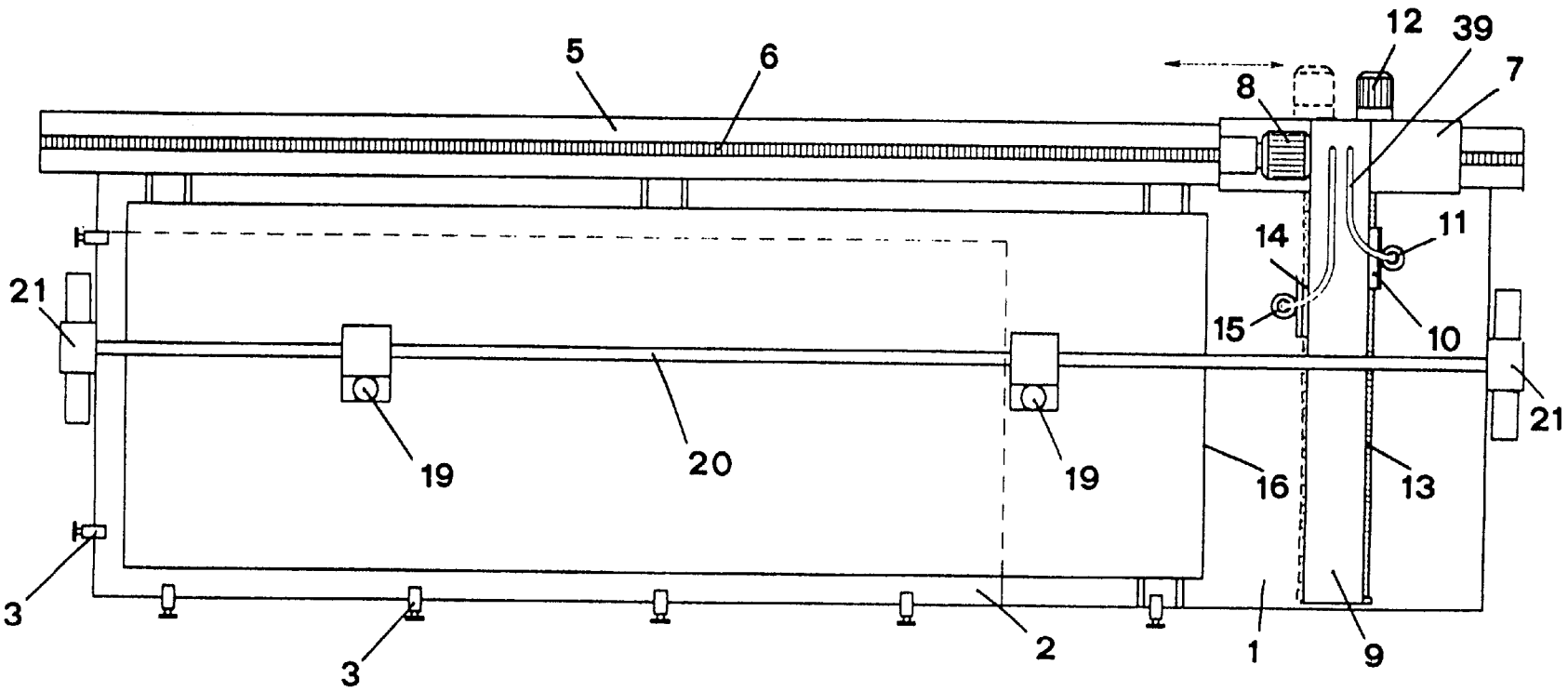
FIG. 1 is a schematic view of the apparatus.

With reference to the above described figures, numeral 1 indicates a support table, on which a panel 2 is placed, maintained in the correct position by means of adjustable ledges 3 and adjustable pressing elements 4.

Attached to the upper surface of the table 1 there are stripe elements 32, made of rubber or another anti-scratch material, on which the panels 2 will be put.

According to the invention, the method includes depositing one or more strips 35 of hot glue onto the panel 2, along a path corresponding to the frame or to the outer border of the mirror to be applied.

Then, before the glue becomes cold and hard the frame or mirror or glass sheet is applied to the panel, either manually or by means of an automatic device connected to the apparatus.

The strips of glue can be continuous or discontinuous. In the drawings, FIGS. 5 to 9, two strips 35 have been shown, but this is only an example and there can be only one strip or three and even more parallel strips 35.

Figure 8:
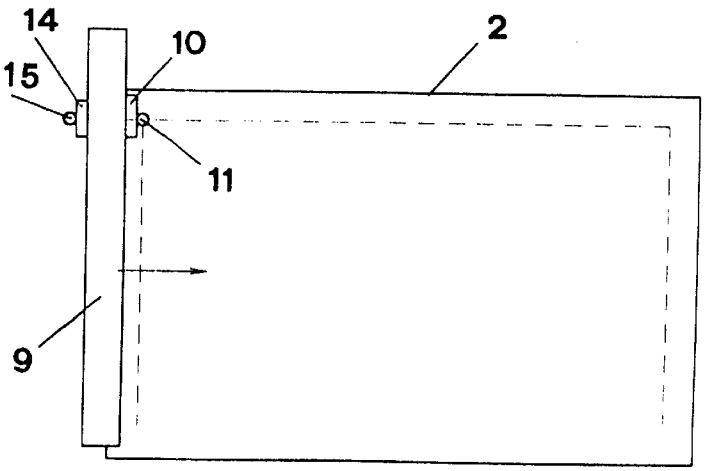

Moreover, other path can be followed or other lines can be added to the path shown in FIG. 8, e.g. a longitudinal middle line or transversal middle line, that are not shown since they are obvious to those skilled in the art.

Preferably, the method just described should be carried out by means of an automatic apparatus, because manual application cannot give strips as precise as they must be, and moreover manual application is too slow, so that when the strips of glue have been completed the glue applied first is already cold and hard.

However, it is to be understood that the method can be carried out by manual application of the strips of glue, by means of a brush or a sprayer pistol.

According to the invention, the apparatus to carry out the method includes a carriage 7, moved by a ratiomotor 8 along a longitudinal guide rail 5 fastened to a side border of the table 1, as shown in FIG. 1.

The motion can be obtained by means of a pinion, not shown in the figures, keyed to the ratiomotor 8 with a toothed wheel meshing with a rack 6 fastened guide rail 5.

It should be understood that other means can be used instead of the ratiomotor 8, the toothed wheel and the rack 6 to move the carriage, such as a screw set parallel to the guide rail and in mesh engagement with a nut thread made in the carriage, or an endless belt extending parallel to the guide rail 5 and fastened in a point to the carriage. A wire can be used in place of the belt.

In any case, the carriage 7 has a cantilevered cross bar 9 protruding therefrom towards the side border of the table opposite to the guide rail 5 and over the panel 2.

Obviously, a second guide rail can be fastened also to the other side of the table with a second carriage sliding thereon. The cross bar 9 is then connected to both the carriages.

A slide 10, supporting with possibility of adjustment, a sprayer pistol 11 for hot glue distribution, is moved along the cross bar 9, e.g. driven by a ratiomotor 12 and a screw 13 engaging a nut thread made in the slide 10.

It should be understood that other means can be used instead of the screw parallel to the cross bar 9 and the nut thread made in the slide 10, such as a ratiomotor 8 connected to a toothed wheel and a rack fastened to the cross bar. Also an endless belt extending parallel to the cross bar 9 and fastened in a point to the slide 10 can be used. A wire can be used in place of the belt.

Figure 2:
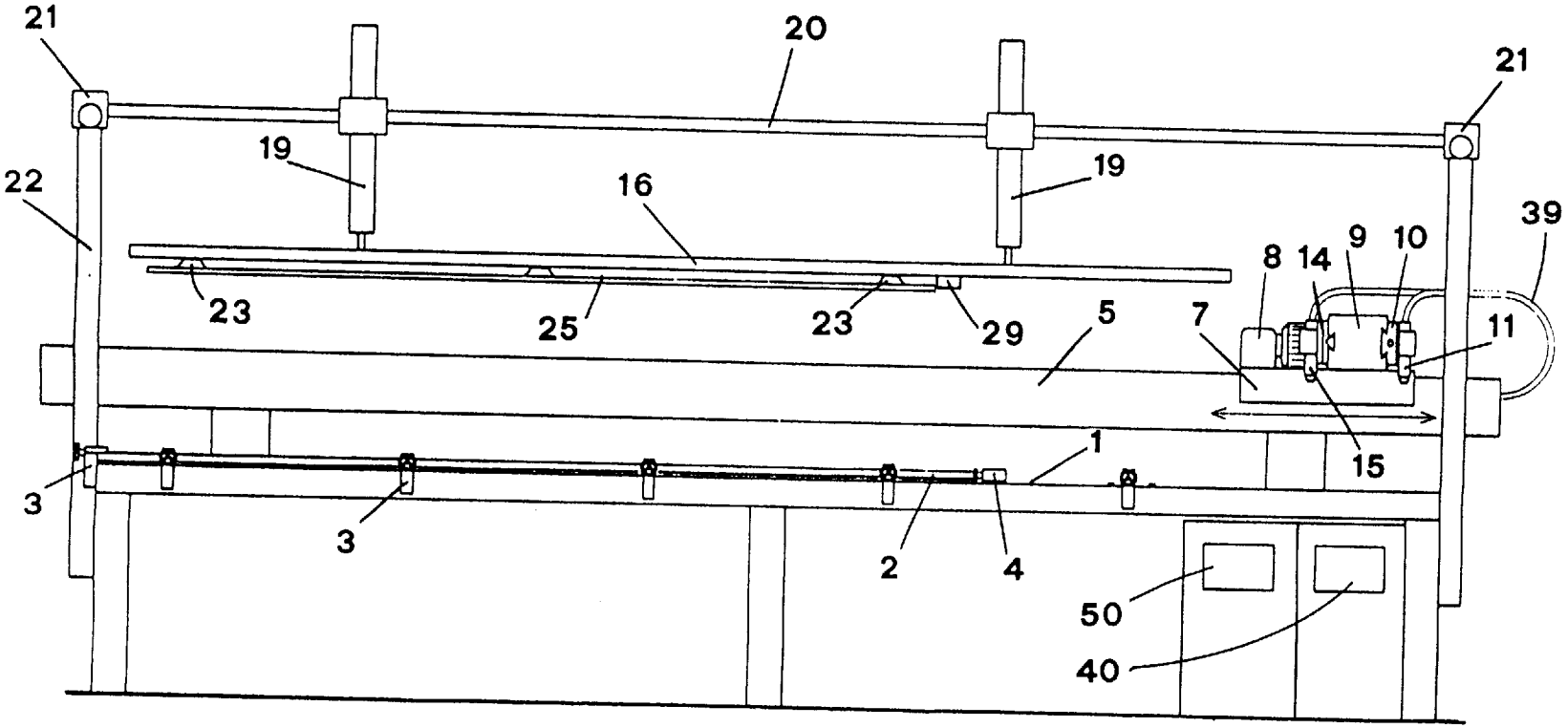
FIG. 2 and FIG. 3 show corresponding front and lateral views of the apparatus.

As shown in FIGS. 1 and 2, the cross bar 9 supports also a non motorised slide 14, which can be placed in any position along the cross bar and fixed thereto by means of locking means, not shown.

A second sprayer pistol 15, for hot glue distribution, is applied to the stationary slide 14 with possibility of adjustment.

In this particular embodiment, two sprayer pistols are used, of which one is movable and one is stationary with reference to the cross bar 9. However, this is only one of the possible embodiments of the invention. A variation is possible according to which only one sprayer pistol is used, preferably the movable one.

According to another possible variation, also the second sprayer pistol 15 is carried by a slide moved along the cross bar 9 by means of a ratiomotor and a screw as shown with a dashed line in FIG. 1. Other means can be use to move the slide as in the previous case.

Figure 4:
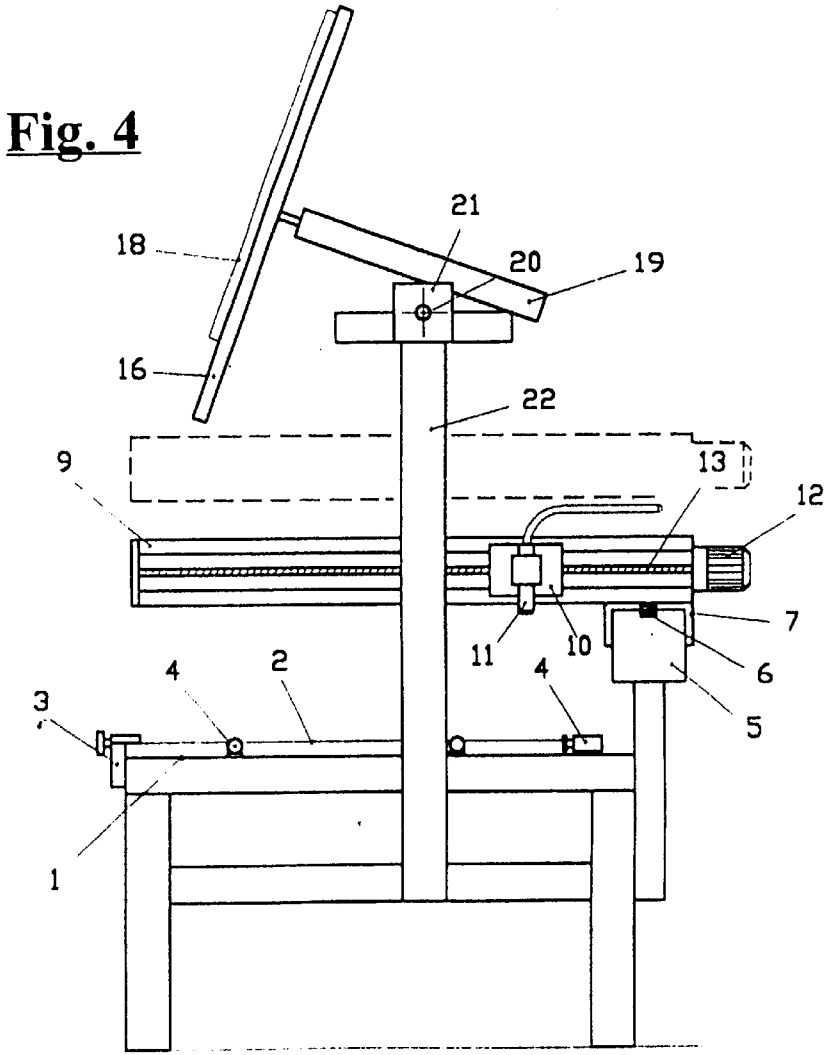
FIG. 4 shows a lateral view of the apparatus with the placing element in a raised position for mirror loading.

Another possible feature of the apparatus includes means for raising and lowering the cross bar 9, that is shown in a raised position with a dashed line in FIG. 4. However, these raising and lowering means are not shown since they are obvious to those skilled in the art.

The glue is delivered to the pistols or nozzles through ducts 39 which are connected to a hot glue supply station 50, as seen in FIG. 2.

Figure 13:
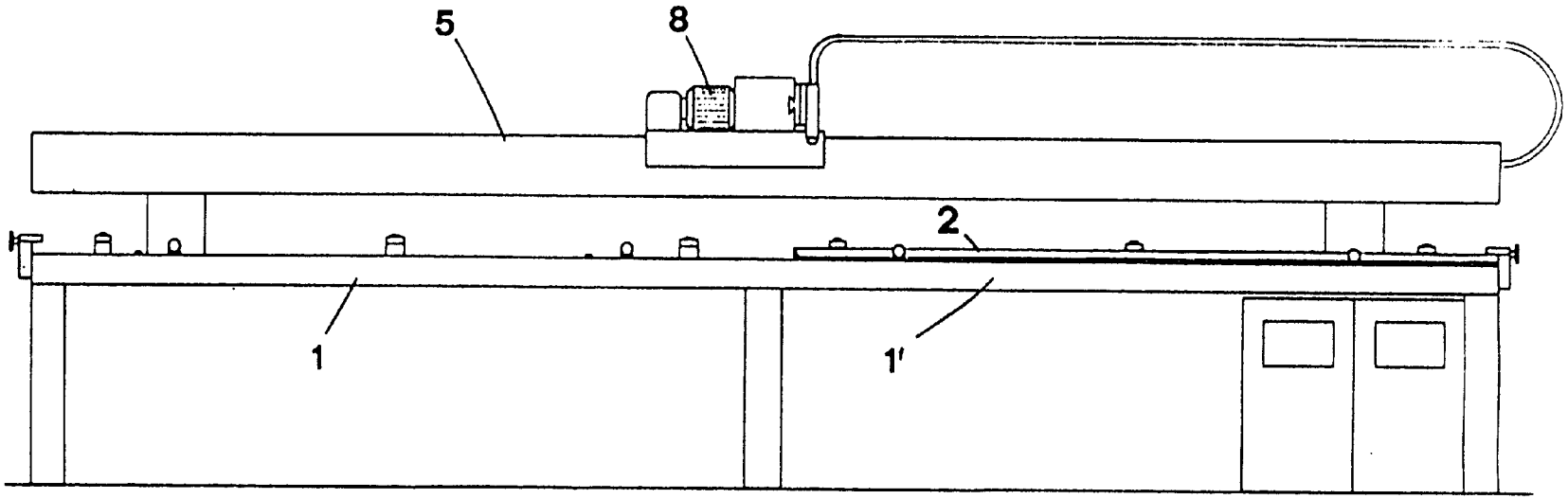
FIG. 13 is a front view of the embodiment shown in FIG. 12.

Lastly, a process control unit, schematically indicated at 40 in FIG. 2 and 13, is connected to the ratiomotors 8 and 12 for cross bar 9 and slide 14 motion control.

FIGS. 5, 6, 7 and 8 show the movements sequences of the cross bar 9 and motorised slide 10 in order to deposit the glue strips 35 onto the panel 2, e.g. following a rectangular path, as it will be better described in the following.

With reference to FIGS. 1 to 4, over the table 1 there is also a flat place and press element 16 which is supported by a longitudinal support bar 20, extending over the table 1 and held by vertical uprights 22 situated at both ends of the table 1.

The longitudinal support bar 20 can be rotated by rotating actuators 21 located at the connecting points between the bar 20 and the uprights 22, while the place and press element 16 can be lowered, and raised after lowering, by pneumatic cylinders 19 fixed to the longitudinal bar 20.

The result is a possibility for the place and press element 16 to rotate about the longitudinal bar 20 and move up and down.

Generally, other means can be used to move the place and press element up and down.

Figure 9:
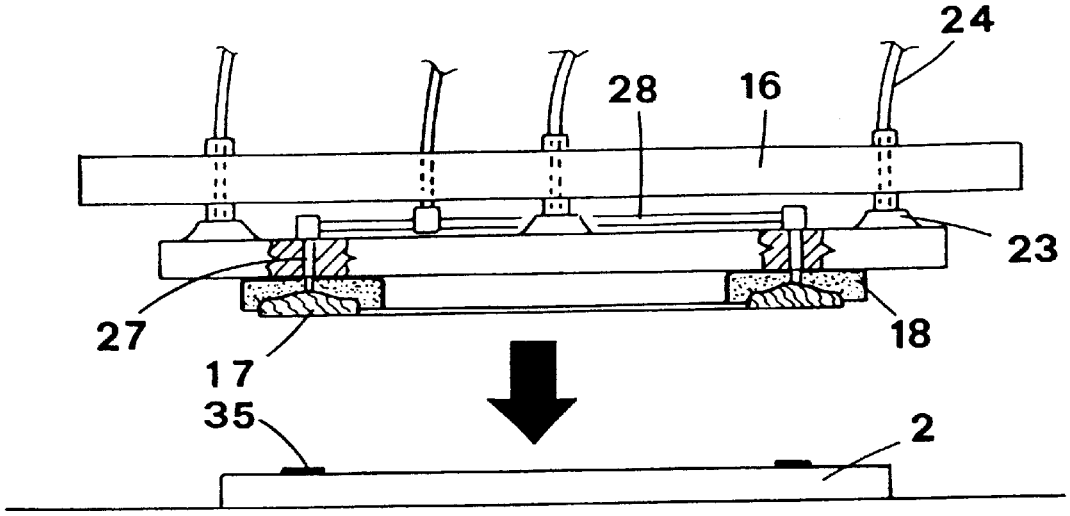
FIGS. 9 and 10 show transversal section views of the placing element supporting a frame inserted in a template, and after application of the frame to the panel, respectively.
Figure 10:
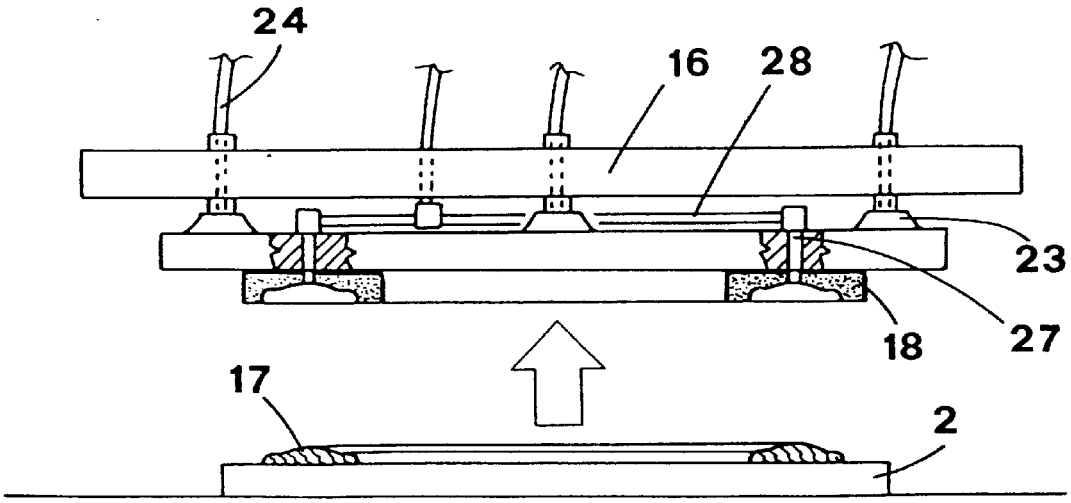

The place and press element 16 is equipped with suction cups 23 connected via suitable spiral ducts 24, shown only in part in FIGS. 9 and 10, to a vacuum system not shown in the figures.

The mirror 25 is held by the suction cups 23 as shown in FIG. 2, before the glue strips are deposited and then applied by lowering of the place and press element 16. If a frame 17 is to be applied to the panel 2, a template 18 should be used.

Figure 11A:
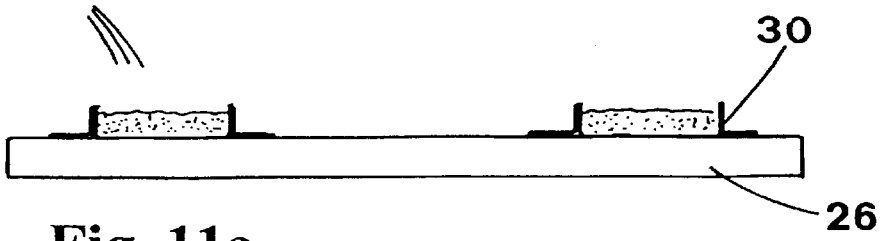
FIGS. 11*a* to 11*c* show the way to make a template used in connection with the apparatus.
Figure 11B:
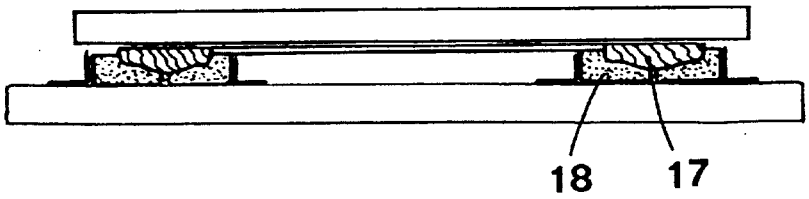

As shown in fugues 11*a*,11*b*,11*c*, the template is obtained by pouring a liquid resin into a mould 30, FIG. 11*a*, together with a catalyst liquid. The mould 30 is made of angle section bars suitably fixed to a plate 26. Then, a panel 2 with a frame 18 already attached thereto is placed over the mould 30 in such a way that the frame 18 is dipped into the resin (see FIG. 11*b*).

Figure 11C:
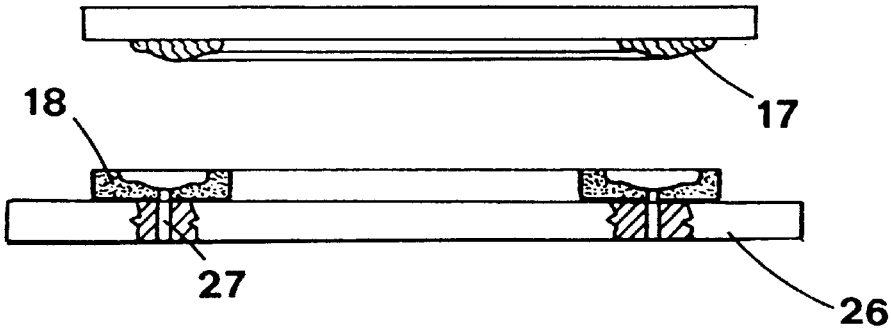

After the resin has become hard, about twelve hours later, the panel 2 is raised and the angle section bars are removed (see FIG. 11*c*).

The template 18 thus obtained has a groove which receives the frame as a tight fit. To improve frame retention and frame ejection, a plurality of through holes 27 are made in the bottom of the groove and in the plate 26. With reference to FIG. 2, the holes 27 are connected via hoses 28 to a suction/pressure source not shown.

In this way a template is obtained in a very quick and easy way and can be mounted without centring operation, as it will be described in the following.

At the beginning of the operation, the stationary slide 14 is positioned so as to run over one side of the path and then fixed to the cross bar.

The movable slide 10 is controlled by the process control unit. In case that also the slide 14 is movable, both the slide are controlled by the process control unit. A suitable programme is loaded in the process control unit, e.g. via a disk drive unit. Obviously, other means can be used to input data, such as a keyboard or a net connection, etc.

Operation description will now consider a case in which a frame 17 is to be applied to the panel.

A sample panel with a frame already attached thereto is set on the table 1. Positioning of the panels is facilitated by peripheral adjustable ledges 3 and adjustable pressing elements 4.

The panel is blocked by pneumatic pressure means 45 which are adjustable along the guide rail 5. The pressure means 45 are better shown in FIG. 12.

The support plate 26 with the template 18 is positioned onto the sample panel with the frame 17 inserted into the groove of the template.

The place and press element 16 is then lowered until the suction cups 23 touch the upper surface of the support plate 26, and then they are activated. Connection of the plate and template assembly is immediate with very high precision. The place and press element 16 is raised and the sample panel removed.

To change the template for another one, e.g. for another panel, the same operation can be carried out in a very short time.

Obviously, other means can be used to fix the template to the place and press element 16, with or without the support plate 26, such as screws or clamp means, without going out of the scope of the invention.

The first panel 2 is set on the table 1 and the place and press element 16 is rotated as shown in FIG. 4. The operator inserts a frame into the groove of the template and then the place and press element 16 is rotated and brought to the position shown in FIG. 3.

Suction is applied to the through holes 27 to safely keep the frame 17 inside the template 18 (see FIG. 9).

Figure 6:
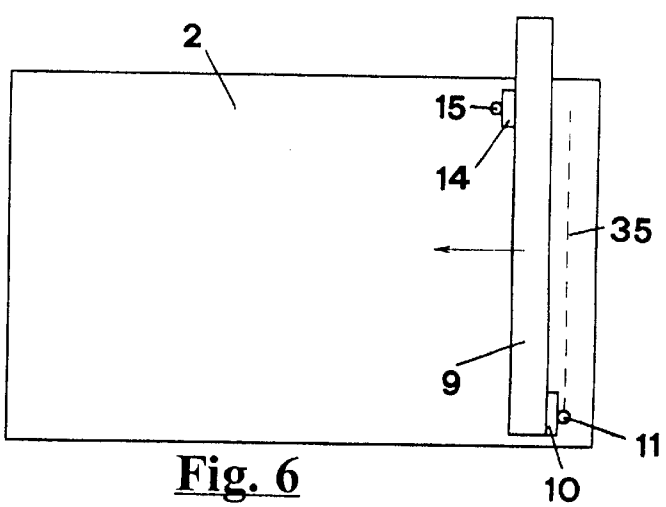
FIGS. 5, 6, 7 and 8 show schematically the sequence of movements of an articulated frame and pistols for glue distribution on a rectangular path.

At this point, the programmable process control unit 40 makes the slide 10 move along the cross bar 9 and the pistol 11 delivers the glue thus forming transversal strips 35 of glue, as shown with broken line in FIG. 6, corresponding to one side of the path.

Figure 7:
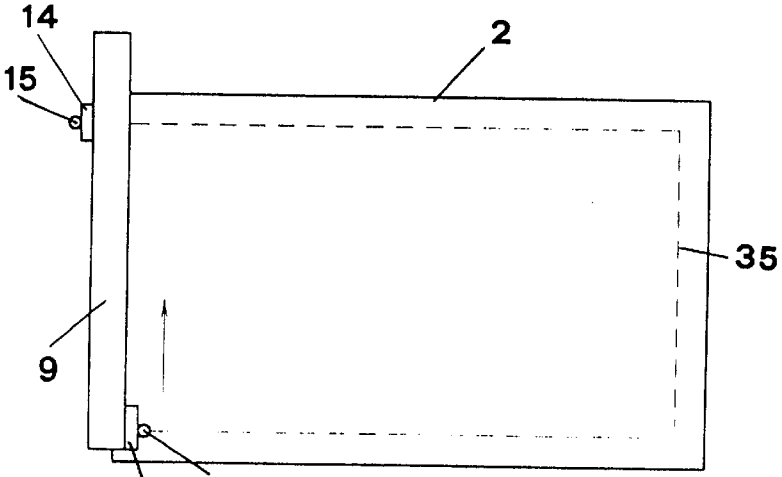

Subsequently, the cross bar 9 is moved, and simultaneously, the glue is delivered by the pistols or nozzles 11 and 15, so as to form longitudinal strips 35 on the two longitudinal sides of the path, as shown with broken line in FIG. 7.

After having reached the final position, the cross bar 9 is stopped, the fixed pistol 15 stops delivering glue and the slide 10 is operated again so as to complete, with the pistol 11 still active, the last side of the path, as shown in FIG. 8.

In case that only one movable sprayer pistol is used, only the longitudinal side of the path is made in the forward stroke of the cross bar 9, while the other longitudinal side of the squared path formed by glue strips is made in the return stroke of the cross bar 9.

If two movable sprayer pistols or nozzles are used, the path will start from a corner with one transversal side of the path deposited by the first movable sprayer pistol, then the two longitudinal side of the path are deposited by both pistols in the forward stroke, and lastly the second transversal side of the path is deposited by the second sprayer pistol. Other paths can be easily followed, such as with longitudinal sides which are not straight lines but curved inwards or outwards.

According to the example shown in the figures, the frame is squared as well as the path followed by the strips 35 of glue.

With other shapes of the frame the strips of glue will follow a corresponding path.

Afterwards, the cross bar 9 is brought again to the rest position of FIG. 1, in order to allow the place and press element 16 to go down to apply the frame and then go up (see FIG. 10) leaving the frame on the panel.

To facilitate extraction of the frame from the template, pressure is applied to the through holes 27 of the template 18.

The panel 2 with the frame 17 attached thereto is removed from the table 1 and a new panel is set thereonto.

Operation description will now consider a case in which a mirror 25 is to be applied to the panel 2.

The first panel 2 is set on the table 1.

The place and press element 16 is rotated as shown in FIG. 4 and a mirror 25 is positioned on the element 16, where suitably located stops 29 determine the precise collocation thereof. In other case, the place and press element 16 can pick up the mirror from a supply line, not shown.

Figure 3:
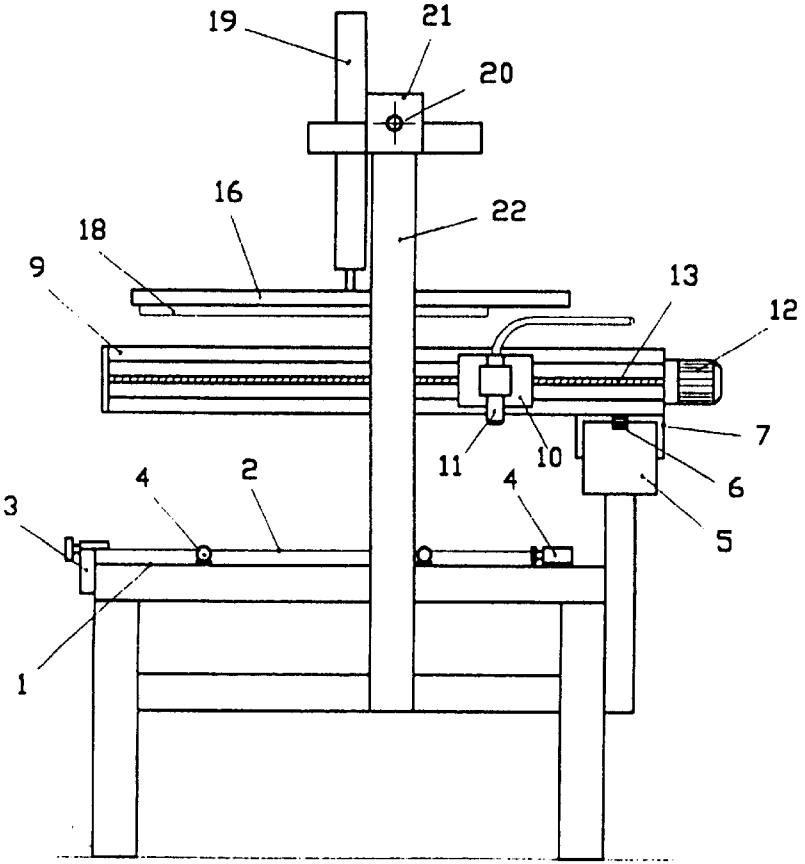

Afterwards the place and press element 16 is rotated and brought to the position shown in FIG. 3.

At this point, the programmable process control unit makes the slide 10 and the cross bar 9 move as already explained before, while the pistols 11 and 35 deliver the glue forming transversal and longitudinal strips 35 of glue, as shown in FIGS. 6 to 9.

Also in this case if only one pistol or two movable pistols or nozzles are provided, operation of the device will proceed as explained hereinabove for the frame application apparatus.

At the end, the cross bar 9 is brought again to the rest position of FIG. 1, in order to allow the place and press element 16 to go down and apply the mirror 25.

The panel 2 is replaced with a new panel without mirror.

It is also possible to apply the mirror manually, that means without using the place and press element 16.

When mirrors or glass sheets are applied manually, the apparatus preferably, but not necessarily, does not include the place and press element 16 with the uprights 22 and the longitudinal bar 20.

In fact, also with apparatus equipped with the place and press element 16 mirrors, frames or glass sheets can be applied manually by setting the place and press element 16 out of operation.

Application of the mirrors, frames or glass sheets in determined position with respect to the panel edges is facilitated by double peripheral adjustable ledges 3, of different height and which project inwards over the panel 2. It is understood that other means can be used to position the mirrors, frames or glass sheets with respect to the panel; the apparatus could be, for instance, equipped with automatic devices which pick the panels, frames or glass sheets from a supply line and place them to the panel without any need of ledges or stops.

Figure 12:
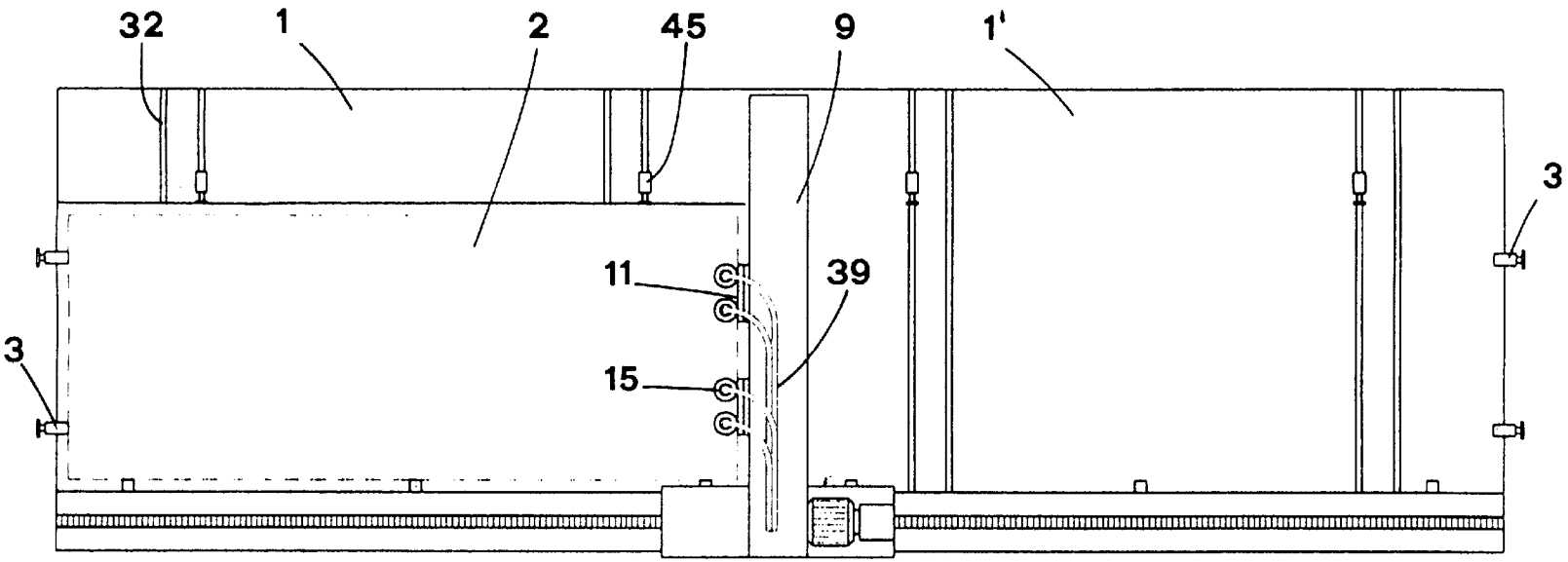
FIG. 12 is a schematic, plan view of the apparatus in a simplified embodiment

An example of this configuration can be seen in FIGS. 12 and 13.

After the strips 35 of glue have been positioned by the sprayer pistols 11,15 the mirror is manually placed on the panel 2.

According to another embodiment shown in FIGS. 12 and 13, the apparatus includes substantially two supporting tables, arranged end to end.

A double support table allows to apply the mirror, or the frame, to one panel, placed on one table, and to load a second panel on the other table 1' meanwhile the first panel is spread with glue.

It is possible to use only one cross bar 9, that slides over one table 1 first and then over the other table 1'. As an alternative configuration, two cross bars 9 can be mounted, with each cross bar sliding over a related table 1,1'.

With reference to FIGS. 12 and 13, numerals 1 and 1' indicate the two end to end support tables, equipped with adjustable ledges 4 and 4' provided for precise and quick positioning of the panels.

As an alternative advantageous solution, substitution of the panels laying on the support tables, arranged side by side, can be performed by a conveying band, with connected thereto manipulators for mirrors and panels.

According to the above description, the apparatus of the invention achieves all the objects stated hereinabove.

After having deposited the glue onto the panel, either at pre-established intervals or continuously, the mirror or the frame can be applied before the glue becomes cold and hard, and therefore the gripping action is always satisfactory.

The glue can be more concentrated in possible points which are more subject to breaking, and anyway it does not produce a rigid connection, so that the panels can be subjected to bending, loads (e.g. when piled) and shock with no mirrors broken or frame detached.

Figure 5:
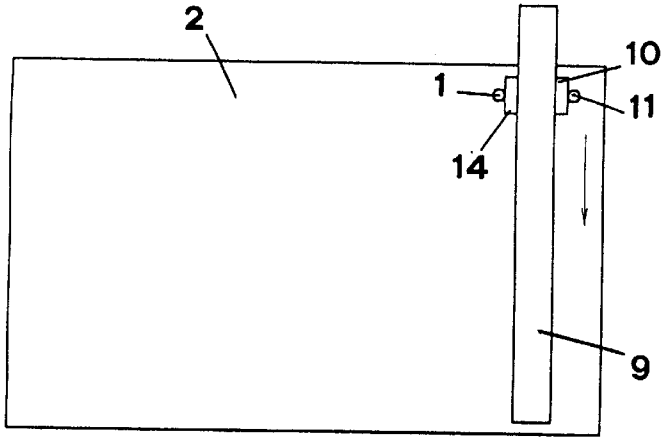

The glue distribution could begin at the side opposite to the one shown in the FIGS. 5 and 6, so as to finish near the cross bar rest position, thus reducing the break between the glue distribution and the frame application, which must occur with the glue still hot.

The articulated pressing, frame supporting element 16 is first made to rotate from the working position of FIGS. 1, 2 and 3 to the position of FIG. 4, in order to allow an easy loading of the frame 17 to the corresponding housing, as seen in FIG. 9.

This housing is a groove having a shape corresponding to the frame shape and made of a synthetic resin or another material of such elasticity that allows to distribute the pressure uniformly on all the parts, so as to compensate for inevitable tolerances and deformations of the frame and the panel.

The carriage 7 could be equipped with another cross bar, or even more, with different pistols or nozzles for hot glue delivery, either motorised or not motorised but adjustable, to be used for gluing mirrors or glass sheets of big dimensions, when it is suitable to add glue distributing units so as to avoid its getting cold too early before the mirror or glass sheet application.

In this case, the place and press element 16 could also be equipped with heating means, aimed at delaying the distributed glue getting cold, or other means improving the apparatus operation and the operator's security. The actuating devices can be of any type suitable for this purpose.

Not essential constructive details can differ from the illustrated ones, which are given as a pure example, remaining within the protective limits of the present invention as defined by claims.

What is claimed is:

1. An apparatus for gluing a mirror, frame or glass sheet to a furniture panel comprising:

at least one table (1), having longitudinal and transverse axes, for supporting a panel (2) thereon;

at least one horizontal cross bar (9) extending over said table (1) and being slidable thereover, the cross bar (9) being connected to a first motor means (8);

at least a pair of slides (10,14), placed along said cross bar (9), each slide equipped with at least one sprayer pistol (11,15) for depositing at least one strip (35) of glue on selected areas of said panel (2);

a second motor means (12) for moving at least a first slide (10) of said pair of slides (10,14) along said cross bar (9);

a programmable process control unit (50), for controlling longitudinal and traversal axis movements of at least one of said pistols (11,15) and said cross bar, (9) as well as glue ejection, in relation to a path to follow, corresponding to the shape of the mirror, frame or glass sheet and, an articulated place and press element (16), supported by a support bar (20) extending over said table (1), rotary actuator means (21) interposed between said support bar and a plurality of uprights (22) which connect said support bar (20) to corresponding ends of said table (1), said place and press element being rotatable from an inclined position, in which the mirror, frame or glass sheet is loaded, to a horizontal working position, where actuator means (19) push the place and press element (16) downward to apply the mirror. frame or glass sheet to the panel, and then pull the place and press element (16) upward leaving the mirror, frame or glass sheet attached to said panel.

2. Apparatus according to claim 1, characterized in that a second slide (14) of said pair of slides (10,14) is fastened to said cross bar (9) in a position that can be changed.

3. Apparatus according to claim 1, characterized in that third independent motor means are provided, connected to the second slide (14) for moving said second slide (14) along said cross bar (9).

4. Apparatus according to claim 1, characterized in that the at least one table has double perimetrical adjustable ledges of different heights, one ledge for positioning the panel and another ledge which protrudes inwardly for positioning the mirror, frame or glass sheet.

5. Apparatus according to claim 1, further comprising a conveying band having manipulators for handling the mirror, frame or glass sheet.

6. Apparatus according to claim 1, characterized in that said cross bar (9) is movable up and down.

7. Apparatus according to claim 1, characterized in that said cross bar (9) is supported, at one end, by a carriage (7) sliding along a guide rail (5) fixed to a longitudinal side of said table (1).

8. Apparatus according to claim 1 characterized in that said first motor means (8) acting onto said cross bar (9) has a ratiomotor and a toothed wheel set in mesh engagement with a rack (6) fixed to a guide rail (5).

9. Apparatus according to claim 1, characterized in that said second motor means (12) acting onto said slide (10) has a ratiomotor and a screw set parallel to said cross bar (9) and in engagement with a nut thread made in said first slide (10).

10. Apparatus according to claim 1, characterized in that said place and press element carries a frame receiving template (18), of a shape corresponding to a frame shape and made of elastic material.

11. Apparatus according to claim 10, characterized in that said template (18) has a receiving groove with a profile corresponding to the profile of a frame (17) to be applied.

12. Apparatus according to claim 10, characterized in that said template includes a plate (26) to which a strip (18) of synthetic resin is attached, said strip (18) of resin having a groove made therein for receiving a frame (17), and with holes (27) made in the bottom of said groove in said strip (18) and through said plate (26), said holes (27) being connected to a vacuum/pressure source.

13. Apparatus according to claim 12, characterized in that said plate (26) is kept firmly fixed to said place and press element (16) by means of suction cups (23) fastened to the place and press element (16) and connected to a vacuum source.

14. Apparatus according to claim 1, characterized in that at one end of said table (1) there is placed a second table (1') joined to the first one.

15. Apparatus according to claim 14, characterized in that said second table has a second cross bar (9) sliding thereover.

16. Apparatus according to claim 14, characterized in that said cross bar (9) of said first table (1) slides also over said second table (1').

17. Apparatus, as in claim 1 further comprising another cross bar, mounted on a carrier (7), and being equipped with at least one glue sprayer pistol, which is adjustable in its position.

18. Apparatus according to claim 1, further comprising automatic devices for moving the panel, frame or glass sheet.

19. Apparatus according to claim 1, further comprising heating means, for delaying cooling of the at least one strip (35) of glue deposited on selected areas of said panel (2).

20. An apparatus for gluing a mirror, frame or glass sheet to a furniture panel comprising:

at least one table (1), having longitudinal and transverse axes, for supporting a panel (2) thereon;

at least one horizontal cross bar (9) extending over said table (1) and being slidable thereover, the cross bar (9) being connected to a first motor means (8);

at least a pair of slides (10, 14), placed along said cross bar (9), each slide equipped with at least one sprayer pistol (11, 15) for depositing at least one strip (35) of glue on selected areas of said panel (2);

a second motor means (12) for moving at least a first slide (10) of said pair of slides (10,14) along said cross bar (9);

a programmable process control unit (50), for controlling longitudinal and traversal axis movements of at least one of said pistols (11,15) and said cross bar, (9) as well as glue ejection, in relation to a path to follow, corresponding to the shape of the mirror, frame or glass sheet;

an articulated place and press element (16), supported by a support bar (20) extending over said table (1), rotary actuator means (21) interposed between said support bar and a plurality of uprights (22) which connect said support bar (20) to corresponding ends of said table (1), said place and press element being rotatable from an inclined position, in which the mirror, frame or glass sheet is loaded, to a horizontal working position, where actuator means (19) push the place and press element (16) downward to apply the mirror, frame or glass sheet to the panel, and then pull the place and press element (16) upward leaving the mirror, frame or glass sheet attached to said panel; and, suction cups and stops fitted to said articulated place and press element (16) for positioning of a mirror, frame or glass sheet.

* * * * *